United States Patent [19]

Hollman

[11] Patent Number: 5,005,729

[45] Date of Patent: Apr. 9, 1991

[54] DISPLACEABLE WASTE BASKET

[76] Inventor: Kevin A. Hollman, 1243 Heulu St., Apt. 302, Honolulu, Hi. 96822

[21] Appl. No.: 468,132

[22] Filed: Jan. 22, 1990

[51] Int. Cl.[5] ..... B65F 1/08

[52] U.S. Cl. ..... 220/908; 220/263

[58] Field of Search ..... 220/1 T, 18, 23.83, 220/23.86, 263, 908, 263

[56] References Cited

U.S. PATENT DOCUMENTS

| | | | |
|---|---|---|---|
| 925,232 | 6/1909 | Sandstrom | 220/18 |
| 994,909 | 6/1911 | DeGrody | 220/18 |
| 2,726,035 | 12/1955 | Meissner | 220/18 X |
| 3,038,629 | 6/1962 | Morton | 220/18 |
| 3,263,854 | 8/1966 | Powers | 220/18 |
| 3,869,979 | 3/1975 | Sulcek | 220/1 T X |
| 4,809,850 | 3/1989 | Laible et al. | 220/1 T X |
| 4,883,189 | 11/1989 | Löbbert | 220/1 T |
| 4,923,080 | 5/1990 | Lounsbury | 220/1 T X |

*Primary Examiner*—Steven M. Pollard

*Attorney, Agent, or Firm*—Michael I. Kroll

[57] ABSTRACT

A displaceable waste basket and a displaceable cabinet shelf tray is disclosed. The displaceable waste basket has a cabinet portion, a waste portion disposed inside the cabinet portion, and a recessed slide mechanism for displacing the waste portion from an extended position to a retracted position and vice versa so that the waste portion is hidden within the cabinet portion when the waste portion is in the retracted position and the waste portion being visible outside the cabinet portion when the waste portion is in the extended position.

9 Claims, 3 Drawing Sheets

DISPLACEABLE WASTE BASKET

BACKGROUND OF THE INVENTION

1. Field of the Invention

The present invention relates to a waste basket and items stored on a cabinet shelf.

More particularly, the present invention relates to a waste basket that is displaceable and cabinet shelves that are displaceable.

2. Description of the Prior Art

The U.S. Pat. No. 3,524,692 to Preston relates to the art of reciprocating racks or holders supported for movement relative to a cabinet between a closed or storing position in which the rack or holder and its contents are concealed within the cabinet and an open position outwardly of the cabinet and in which the contents of the rack or holder are accessible to the user.

The prior art discloses holders or racks mounted for travel into and out of a cabinet compartment and supported by rollers travelling in or on tracks.

A holder that can be manually rocked slightly in the opposite direction by an upward force exerted thereon to permit the rollers to pass under the stops and enable the holder to then be moved to a more fully extended position.

Ramps are formed in the tracks and disposed to be engaged by the rollers as the holder reaches a fully open position to enable the holder to rock downwardly and into a position to permit the waste receptacle supported thereby or the contents thereof to be readily removed from the holder.

The U.S. Pat. No. 3,524,692 to Preston teaches a holder for a waste basket mounted for movement on tracks between a retracted position, wherein the weight of the holder and its contents causes it to rock slightly during its movement toward an open position so that rollers which engage the tracks will strike stops to interrupt outward 20 movement of the holder before it has reached a fully open position and ride off the tracks.

The U.S. Pat. No. 3,528,718 to Johnson relates to garbage cans or containers including a lining therefore to enable movement of the can from a stored concealed and sealed condition to an extended position where it is capable of receiving waste material.

Waste containers including garbage cans are conventionally placed in a convenient corner or the like in the kitchen or other area in which the container is to be used. Frequently, removable liners are provided for such containers and these generally are in the form of conventional paper bags, plastic bags, or the like in which the mouth of the bag is merely laid over the top of the container.

Cans receiving kitchen wastes are usually provided with a can which can be opened by a step-on mechanism. Other developments in this art include garbage containers which are mounted in concealed relation within a cabinet or the like and when the container is moved to an exposed position, the container lid is automatically opened. An example of this type of construction is found in U.S. Pat. No. 2,934,390. An example of a garbage can with a liner is found in U.S. Pat. No. 1,886,406. However, such devices have not been accepted in the field of use as the structures have failed to dependably produce the desired results.

The U.S. Pat. No. 3,528,718 to Johnson teaches a container such as a garbage can of a relatively large capacity having a liner disposed therein with a detachable connection between the upper end of the liner and the upper end of the container to stabilize the liner within the container but yet enable ready removal thereof with the connecting structure and the liner serving as a rigidifying handle to enable lifting of the liner when it has been filled with waste material.

The garbage container forms a component 10 and includes a substantially flat bottom 12 of a rectangular configuration and upstanding end walls 14 and sidewalls 16 which terminate at the upper edge thereof in an outwardly extending flange 18 which in turn terminates in a downwardly extending flange 20.

The downwardly extending flange 20 is substantially continuous but discontinuously at 22 along the end walls thereof to provide handholds for facilitating removal of the container 10. Attached to the upper surface of the peripheral flange 18 is a rib 24 of cylindrical configuration which is secured thereto by any suitable means such as by an ahesive or being molded as an integral part thereof or attached thereto by a heat sealing operation or the like as at 26.

The central portion of the rib along each sidewall 16 is discontinuous at 8. Also, each side portion of the flange 18 is provided with a pair of depending projections 30 each of which is in the form of a shank having a rounded enlargement 32 on the lower end thereof which has a particular function.

The U.S. Pat. No. 4,120,548 Manor relates to bins which serve domestic purposes and which may be kept in a cupboard or similar compartment.

It is known to suspend the bin from and alongside of a parallelogram four-bar-linkage. The rear one of the bars extends vertically and in parallel with the inner side of the door of the respective cupboard, and is adapted to be affixed to a doorpost or like stationary member. The opposite front bar of the four-bar-linkage is provided with means for removably affixing thereto the bin. Some kind of stop means has to be provided in order to arrest the system in the elevated position to prevent it from collapsing back under the weight of the loaded bin.

The provision of such stop means has caused inconvenience in the use of the device and increased the manufacturing costs thereof.

In the usual cases where the bin assembly is installed in a kitchen cupboard. The conventional arrangement did not provide for the interchangeability between right and left-hand mounting requisites. Hence, two different types of holder units had to be produced and sold separately to the public, and/or always readily available in inventory.

The U.S. Pat. No. 4,120,548 to Manor teaches a displaceable garbage bin holder having a support frame swingable about a vertical axis provided at a rear side of the frame and a linkage system for the vertical displacement of the bin. The linkage system includes first, second, and third link-bars. The first link-bar is pivotably mounted at one end to the front end of the frame by a first journal. The second link-bar is pivotably mounted at one end to the front end of the frame by a second journal located below the first journal. The first link-bar is pivotably mounted to the opposite ends of the first and second link-bars by third and fourth journals, respectively. Means are provided for suspending a garbage-bin on the third link-bar and a handle for pivoting the linkage system about the first and second journals so that the third journal is displaced from a lower position to an elevated position beyond the upper dead-center of the linkage system defined by a line passing through the first and second journals for stably supporting the linkage system in an elevated position.

For interchangeability, the frame includes an upper frame-bar and a lower frame bar. The first and second link-bars are installed at one side of both the upper and lower frame-bars. The third link-bar extends across the opposite sides of the upper and lower frame-bars, respectively.

Numerous innovations for waste baskets have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a displaceable waste basket tray and disposable cabinet shelf tray that avoids the disadvantages of the prior art.

More particularly, it is an object of the present invention to provide a displaceable waste basket tray and disposable cabinet shelf tray that stores a waste basket on a cabinet shelf tray. The waste basket extends outwardly to a maximum of half the depth of the trays as the cabinet door is opened.

As well as the displaceable shelf tray where items are stored at the rear of the cabinet are now at the front of the cabinet and the items at the front of the cabinet are now outside of the cabinet cavity for easier accessibility. The tray slides out as the door opens, as opposed to pulling the trays in and out by hand. Trays sizes of various widths are available for 12", 14", 16", side cabinets, and for left or right cabinet door swings.

The present invention can be easily installed into such an enviroment.

Made of a strong plastic that takes the shape of a tray or shelf tray with a raised bordering edge that will either hold within it a plastic 6 and 8 gallon wastebasket or items that would be stored on a cabinet shelf. Under the tray is a recessed slide mechanism that is mounted to the bottom shelf of the cabinet. A metal arm that is in the shape of a quarter arc of a circumference is mounted to the recessed slide mechanism and it is attached to the inside of the lower portion of the cabinet door. Hence, as the cabinet door is opened, the trays slide outward to the user to access the wastebasket or stored items and then as one closes the cabinet door the trays slide back into the cabinet cavity.

In keeping with these objects, and with others which will become apparent herinafter, one feature of the present invention resides, briefly stated, in a displaceable waste basket having a cabinet portion, a waste portion disposed inside the cabinet portion wherein means for displacing the waste portion from an extended position to a retracted position and vice versa, is provided.

When the displaceable waste basket is designed in accordance with the present invention, the waste portion is hidden within the cabinet portion when the waste portion is in the retracted position and the waste portion is visible outside the cabinet portion when the waste portion is in the extended position.

In accordance with another feature of the present invention, the cabinet portion is a substantially hollow cube that has a front door hinged to the side of the hollow cube.

Another feature of the present invention is that the cabinet portion is wood, but is not limited to it.

Yet another feature of the present invention is that the waste portion is a substantially hollow cube that has an open top.

still another feature of the present invention is that the waste portion is plastic, but is not limited to it.

Yet still another feature of the present invention is that the displacing means include a base tray, a door arm having an end and another end, and a recessed slide mechanism.

Still yet another feature of the present invention is that the base tray has a raised boarding edge and a front.

Another feature of the present invention is that the base tray is plastic, but is not limited to it.

Yet another feature of the present invention is that the door arm has a body portion with an end and another end.

still another feature of the present invention is that the door arm is metallic, but is not limited to it.

Yet still another feature of the present invention is that the recessed mechanism has an upper "U"-channel member and a lower "U"-channel member disposed telescopically.

Still yet another feature of the present invention is that the upper "U"-channel member is mounted to the bottom of the base tray.

Another feature of the present invention is that the lower "U"-channel member is mounted to the bottom shelf of the cabinet portion.

The invention of the wastebasket tray portion of the present invention is to fit in the bottom of a cabinet located under the kitchen sink where a conventional plastic wastebasket that fits in the wastebasket tray.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 2:
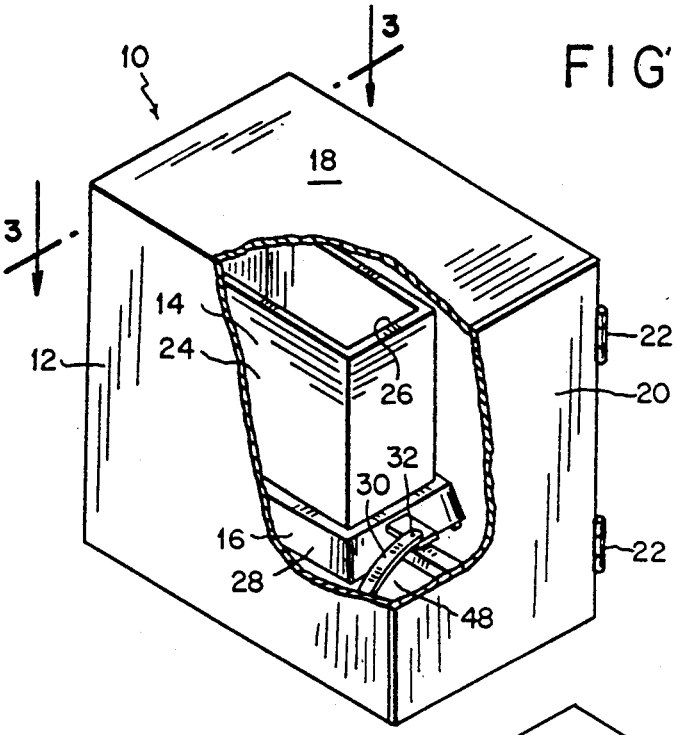
FIG. 2 is a perspective view of the present invention in the closed position with part of the cabinet cut away.

10—displaceable waste basket
12—cabinet portion of the displaceable waste basket 10
14—waste portion of the displaceable waste basket 10
16—means for displacing the waste portion 14
18—large substantially hollow cube
20—front door of the substantially hollow cube 18
22—hinges for attaching the front door 20 to the substantially hollow cube 18
24—small substantially hollow cube
26—open top of the small substantially hollow cube 24
28—base tray for receiving basket 24
30—door arm attached to the base tray 28
32—an end of the door arm 30
34—another end of the door arm 30
36—raised boarding edge of the base tray 28
38—front of the base tray 28
40—body portion of the door arm 30
42—recessed slide mechanism
44—upper "U"-channel of the recessed slide mechanism 42
46—lower "U"-channel of the recessed slide mechanism 42
48—bottom shelf of the cabinet portion 12
50—bottom portion of the base tray 28
52—ribs on the bottom portion 50 of the base tray 28
28'—base tray of the first alternate embodiment
58'—face of the base tray 28'
60'—bearing caster type wheels
62'—pivot pin
64'—bushing
28"—base tray of the second alternate embodiment
54"—filler insert to be mountable in the base tray 28"
56"—another filler insert mountable in the base tray 28", when necessary
58"—face of the base tray 28"

DETAILED DESCRIPTION OF THE PREFERRED EMBODIMENT

Figure 1:
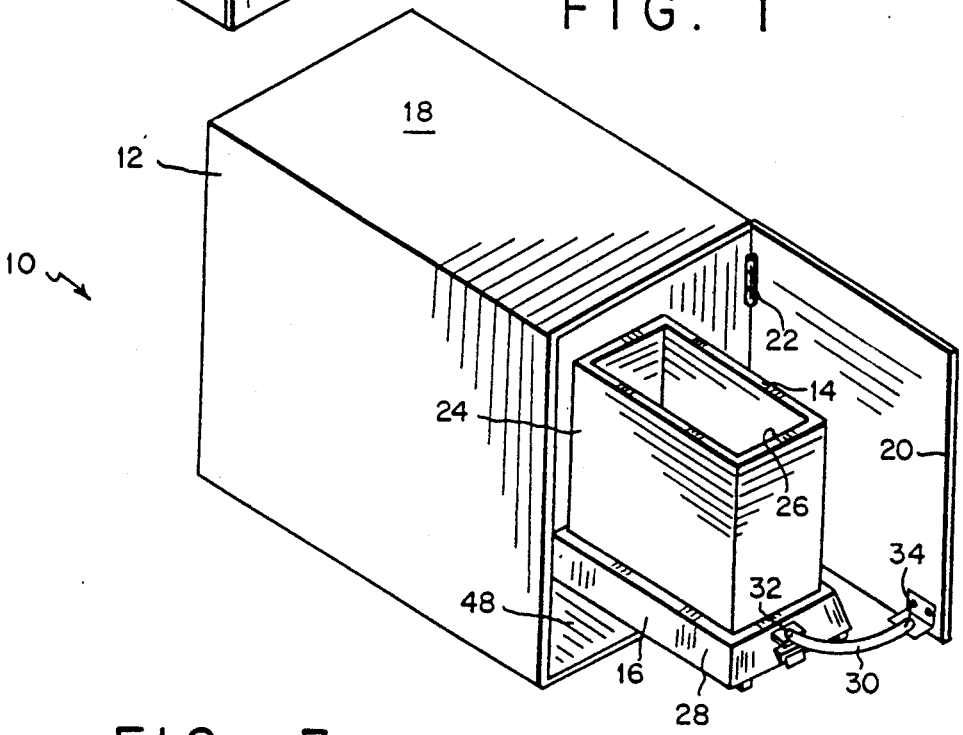
FIG. 1 is a perspective view of the present invention in the open position.
Figure 3:
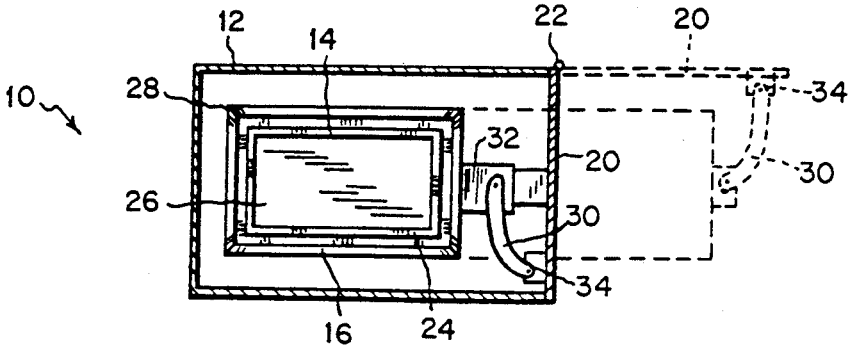
FIG. 3 is a cross-sectional plan view of the present invention in the closed position, and taken along line 3—3 of FIG. 2 and is superimposed with a cross sectional view, in phantom, of the present invention in the open position.

Referring now to FIGS. 1 through 3, the displaceable waste basket of the present invention is shown generally at 10, and includes a cabinet portion 12, a waste portion 14, and means 16 for displacing the waste portion 14, from an extended position to a retracted position and vice versa.

The cabinet portion 12 of the displaceable waste basket 10 is a substantially hollow cube 18, having a front door 20 hinged at 22 to the side of the hollow cube 18 which may be made out of wood, but it is not limited to it.

Figure 4:
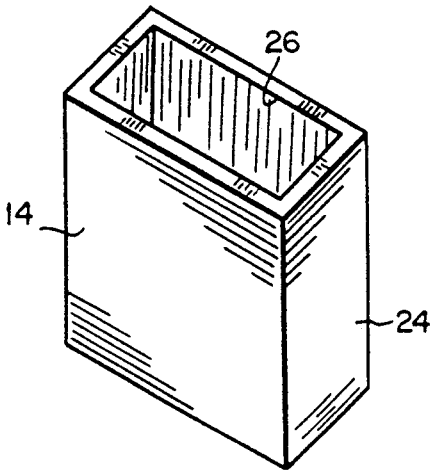
FIG. 4 is a perspective view of a conventional wastebasket.

The waste portion 14 of the displaceable waste basket 10 is a substantially hollow cube 24 with an open top 26, as shown in FIG. 4.

Figure 5:
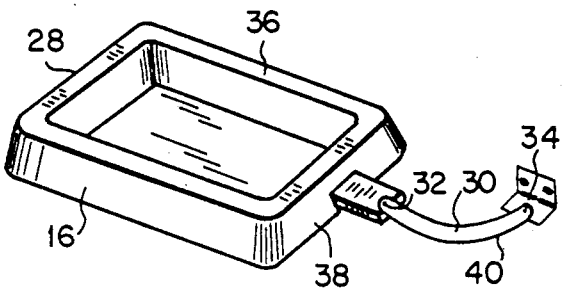
FIG. 5 is a perspective view of the door arm mounted to the slide mechanism of the present invention.
Figure 8:
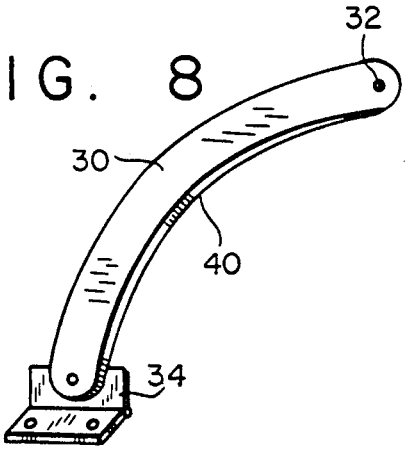
FIG. 8 is a perspective view of the door arm of the present invention.
Figure 7:
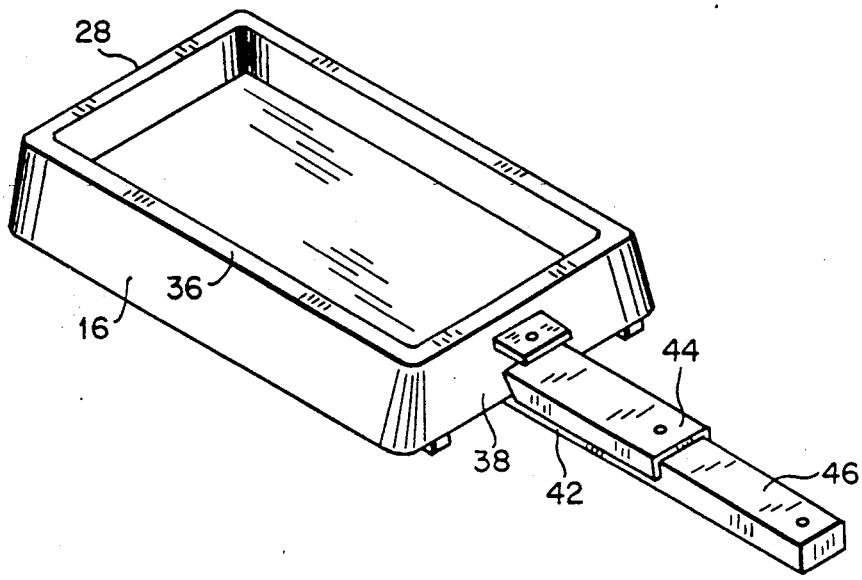
FIG. 7 is a perspective view of the slide mechanism mounted to the tray of the present invention.

Means 16 of the displaceable waste basket 10 include a base tray 28, a door arm 30 having an end 32 and another end 34, as shown in FIGS. 5, 7, and 8.

Figure 11:
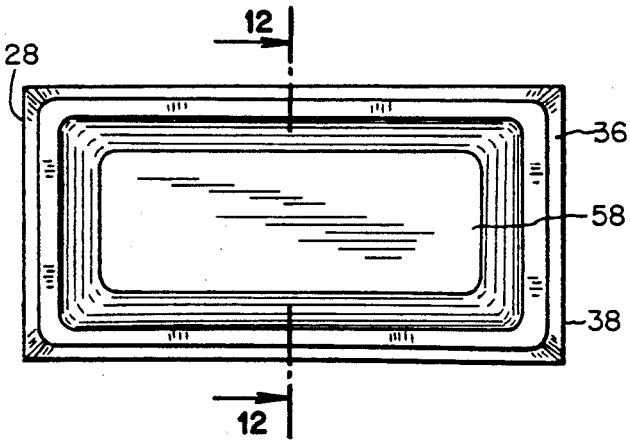
FIG. 11 is a plan view of the top of the base of the present invention.

The base tray 28 of the displaceable waste basket 10 further includes a raised bordering edge 36 and a front 38, as shown in FIGS. 5, 7, and 11. The base tray 28 may be made out of plastic, but it is not limited to it.

The door arm 30 of the displaceable waste basket 10, as shown in FIGS. 5 and 8, includes a body portion 40, and end 32 and another end 34. The door arm 30 may be metallic, but it is not limited to it.

Figure 6:
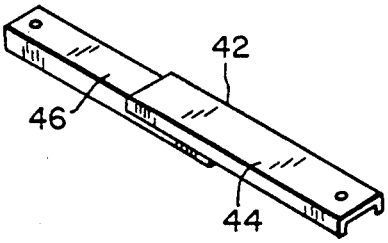
FIG. 6 is a perspective view of the slide mechanism of the present invention.

The recessed slide mechanism 42, shown in FIGS. 6 and 7, includes an upper "U"-channel member 44 and a lower "U"-channel member 46, disclosed telescopically. The upper "U"-channel 44 is mounted to the base tray 28, and lower "U"-channel member 46 is mounted to the bottom shelf 48 of the cabinet portion 12.

Figure 10:
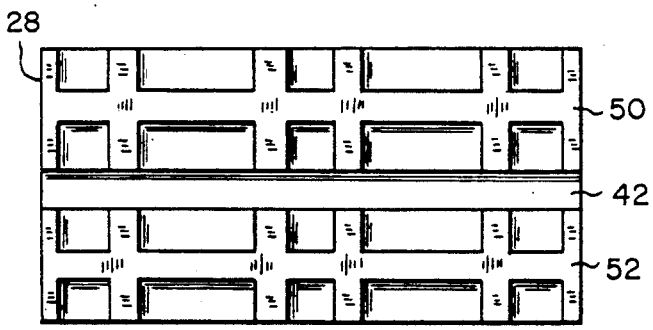
FIG. 10 is a plan view of the underside of the bae of the present invention.

As shown in FIG. 10, the base tray 28, has a bottom portion 50 which is made with ribs 52 for strength and a recessed slide mechanism 42.

Figure 9:
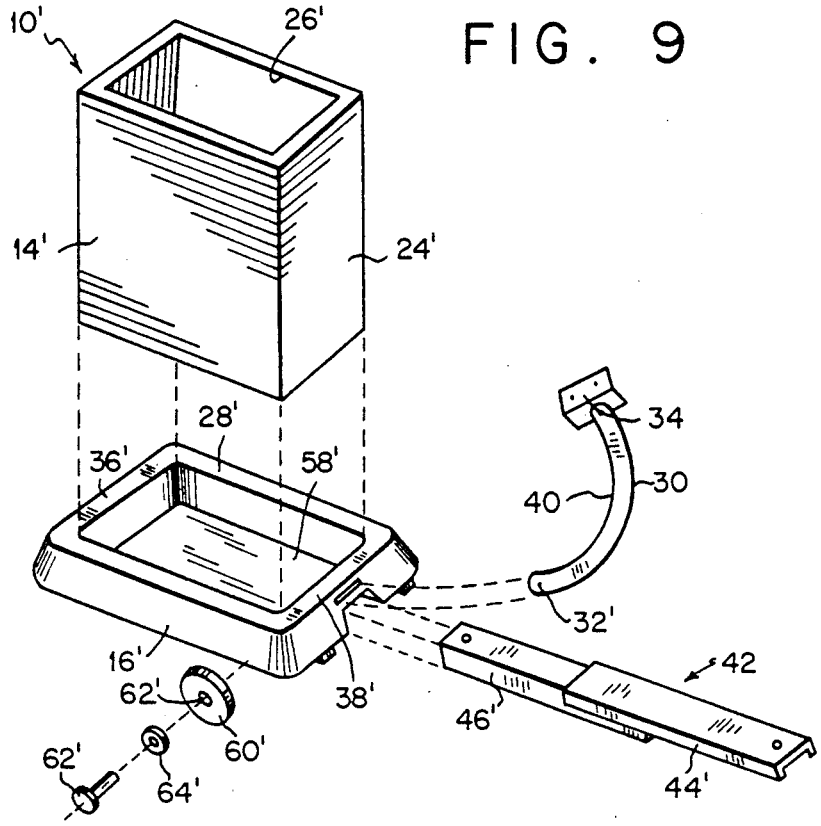
FIG. 9 is an exploded perspective view of an alternate embodiment of the present invention.

An alternate embodiment of the present invention is shown in FIG. 9. The base tray 28' further includes bearing casters 60' at the rear of the tray 28' for support while the bushing 64' and pivot pins 62' are used to mount the door arm. All of the other parts of the alternate embodiment 10' are substantially the same as those of the preferred embodiment 10.

The pivot pin 62' is made out of metal, the bushing 64' plastic, and the slide mechanism 42' metal, but they are not limited to it.

Figure 12:
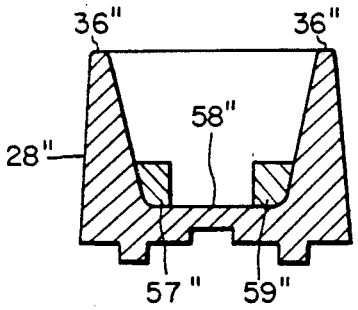
FIG. 12 is a cross-sectional view of the present invention taken along line 12—12 of FIG. 11.
Figure 13:
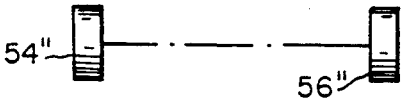
FIG. 13 is an end view of the inserts used in FIG. 12 to fit two different sized waste baskets.

A third alternate embodiment of the present invention is shown in FIGS. 12 and 13. The base tray 28" further includes filler inserts 54" and 56". The filler inserts 54" and 56" permit two different sized waste baskets to alternate onto the base tray 28".

As shown in FIGS. 12 and 13, a pair of filler inserts 54" and 56" present yet another alternate embodiment. By placing the filler inserts 54" and 56" on to the face 58" of the face tray 28", the base tray 28" has the ability to alternate two different sized waste baskets.

It will be understood that each of the elements described above, or two or more together, may also find a useful application in other types of constructions differing from the type described above.

While the invention has been illustrated and described as embodied in a displaceable waste basket and displaceable cabinet shelf trays it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A displaceable waste basket, comprising:

(a) a cabinet portion having a door that opens to the side to save space when being used and void of a handle and a frame;

(b) a reuseable waste portion disposed inside said cabinet portion and having an open top void of any closure members, said reuseable waste portion coming out of said cabinet portion automatically when said door of said cabinet portion is opened, container can service said cabinet either inside or outside but not simultaneously and depending upon where it is installed; and (c) means for displacing said waste portion from an extended position to a retracted position and vice versa so that said waste portion being hidden within said cabinet portion when said waste portion is in the retracted position and said waste portion being visible outside said cabinet portion when said waste portion is in the extended position, said displacing means include a base tray, a door arm having a first end and a second end, and a recessed slide mechanism, said recessed slide mechanism and said door arm are so attached to said base tray that when said door is opened said base tray comes out automatically and vice versa.

2. A waste basket as defined in claim 1, wherein said cabinet portion is a substantially hollow cube that has said front door hinged to the side of said hollow cube.

3. A waste basket as defined in claim 2, wherein said waste portion is a substantially hollow cube having said open top.

4. A waste basket as defined in claim 3, wherein said base tray has a raised boarding edge and a front.

5. A waste basket as defined in claim 4, wherein said door arm has a body portion with an end and another end.

6. A waste basket as defined in claim 5, wherein said door arm is metallic.

7. A waste basket as defined in claim 6, wherein said recessed mechanism has an upper "U"-channel member and a lower "U"-channel member, disposed telescopically.

8. A waste basket as defined in claim 7, wherein said upper "U"-channel member is mounted to the bottom of said base tray.

9. A waste basket as defined in claim 8, wherein said lower "U"-channel member is mounted to the bottom shelf of said cabinet portion.

* * * * *